United States Patent [19]

Kinoshita

[11] Patent Number: 4,587,911

[45] Date of Patent: May 13, 1986

[54] WORKPIECE HOLDING-DOWN DEVICE IN A SEWING MACHINE

[75] Inventor: Tomoaki Kinoshita, Kanagawa, Japan

[73] Assignee: Tokyo Juki Industrial Co., Ltd., Chofu, Japan

[21] Appl. No.: 670,917

[22] Filed: Nov. 13, 1984

[51] Int. Cl.[4] ..... D05B 29/02

[52] U.S. Cl. ..... 112/239; 112/311

[58] Field of Search ..... 112/239, 235, 311, 312, 112/320

[56] References Cited

U.S. PATENT DOCUMENTS 2,970,557 2/1961 Schwab et al. ..... 112/239 X 4,214,543 7/1980 Garron et al. ..... 112/320

FOREIGN PATENT DOCUMENTS 1133615 7/1957 Fed. Rep. of Germany ..... 112/320

*Primary Examiner*—Werner H. Schroeder

*Assistant Examiner*—Andrew M. Falik

*Attorney, Agent, or Firm*—Yount & Tarolli

[57] ABSTRACT

A sewing machine with a workpiece holding-down device comprises an arm movable between an upper position and a lower position and normally biased to the upper position. An auxiliary workpiece holding-down member is movable between an upper position and a lower position in synchronization with the rotation of a main shaft and is normally biased to the upper position. A disengageable interconnecting means is interposed between the main shaft and auxiliary holding-down member. Electromagnetic means is energized upon starting of a sewing operation and is deenergized upon the completion of formation of a seam. An operation means is operable in response to energization of the electromagnetic means to impart an operative force to the auxiliary holding-down member and a holding-down arm and releases the operative force in response to the deenergization of the electromagnetic means.

2 Claims, 3 Drawing Figures

WORKPIECE HOLDING-DOWN DEVICE IN A SEWING MACHINE

BACKGROUND OF THE INVENTION

This invention relates to a sewing machine and more particularly, to a workpiece holding-down device in a sewing machine. When a sewing machine is about to start operation, a workpiece holding-down foot is lowered down onto a workpiece to hold the workpiece on the sewing machine bed, the sewing machine is then driven to perform a sewing operation on the workpiece as the workpiece is fed incrementally. At the completion of formation of a predetermined number of seams on the workpiece, the holding-down foot is raised from the workpiece. More particularly, this invention relates to such a sewing machine provided with an auxiliary workpiece holding-down member adapted to hold the workpiece down at an area adjacent to the needle drop point when a seam is formed within the limit defined by the frame of a frame-shaped holding-down foot.

Conventionally, when an embroidering or tacking seam is formed on a workpiece by such a sewing machine, a frame-shaped workpiece holding-down foot holds the workpiece against the workpiece feed bar. A seam is formed on the workpiece within the frame defined by the foot. However, in order to prevent the workpiece from rising due to resistance to the needle when the needle pierces through the workpiece and moves upwardly and downwardly substantially in the center of the frame of the foot, there is provided an auxiliary workpiece holding-down member which moves upwardly and downwardly at an area adjacent to the needle drop point in response to the upward and downward movement of the needle. The auxiliary holding-down member holds the workpiece down while the needle resides within the workpiece. However, there is the possibility that the auxiliary holding-down member may engage and damage the workpiece holding-down member when the workpiece holding-down member rises sufficiently high to permit feed and removal of the workpiece to and from the sewing area.

SUMMARY OF THE INVENTION

Thus, the present invention has as its purpose to eliminate the drawback inherent in the prior art sewing machines by a simple arrangement in which the auxiliary workpiece holding-down member is designed to move upwardly and downwardly together with the workpiece holding-down member.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

Figure 1:
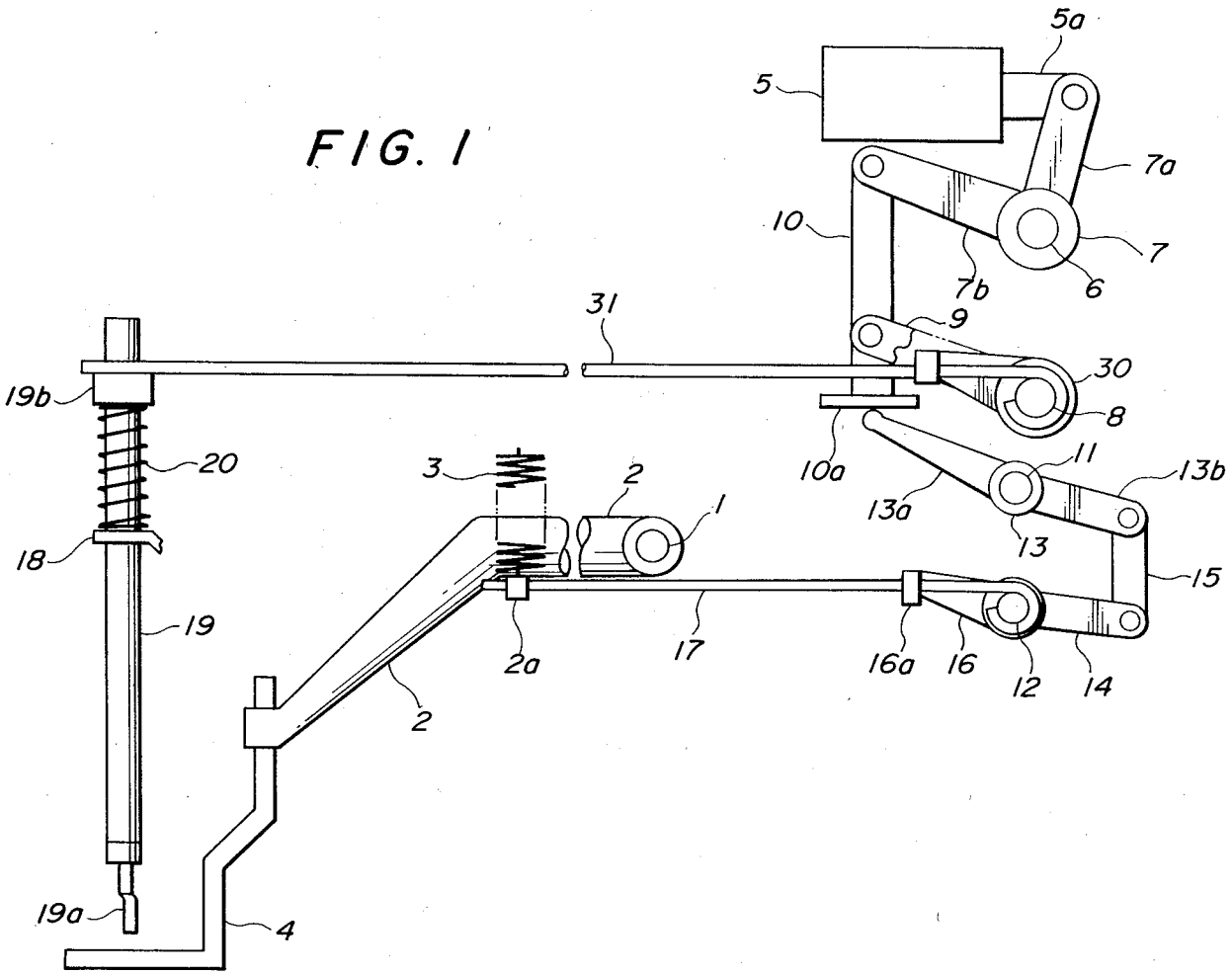
FIG. 1 is a front elevational view of the preferred embodiment of the workpiece holding-down device in a cycle sewing machine of the present invention.

The present invention will be now described referring to the accompanying drawings in which the preferred embodiment of the workpiece holding-down device in a sewing machine of the present invention is illustrated. In FIG. 1, reference numeral 1 denotes a horizontal support shaft having its axis extending at right angles to the axis of the main shaft of a cycle sewing machine (not shown). The support shaft 1 is supported on the feed bar (not shown) which is movable horizontally under the control of a workpiece feed direction control means (not shown) in synchronization with the operation of the sewing machine. A holding-down arm 2 is pivoted at the base end to the support shaft 1 for rotation about the axis of the shaft and has a substantially U-shaped engaging portion 2*a* extending downwardly from an intermediate position between the opposite ends of the arm. A coil spring 3 is anchored at the opposite ends to the framework of the sewing machine framework and the engaging portion 2*a* to normally resiliently urge the holding-down arm 2 in the clockwise direction as shown in FIG. 1. A frame-shaped holding-down foot 4 is fixedly secured to the leading or lower end of the holding-down arm 2.

Reference numeral 5 denotes an electromagnet which is adapted to be energized when the sewing machine is about to start operation so as to pull an operation bar 5*a* leftward as seen in FIG. 1. The electromagnet 5 is deenergized after the completion of one cycle of a sewing operation on the sewing machine so as to retract the operation bar 5*a* rightwards as seen in FIG. 1. A horizontal support shaft 6 is suitably supported on the framework of the sewing machine and has the axis parallel to the axis of the support shaft 1. A drive arm 7 is pivoted at one end to the support shaft 6 for rotation about the axis of the shaft and has a pair of arm portions 7*a* and 7*b* which are disposed at an angle to each other with the arm portion 7*a* connected to the operation bar 5*a* for the electromagnet 5. A horizontal support shaft 8 is suitably supported on the framework of the sewing machine and is parallel to and below the support shaft 6. An arm 9 is pivoted at one end on the support shaft 8. A connector 10 has an engaging portion 10*a* at its lower end. The connector 10 is rotatably connected at the upper and lower ends thereof to the leading ends of the other arm portion 7*b* of the drive arm 7 and of the arm 9. The arm portion 7*b*, arm 9 and connector 10 constitute a first link means.

A horizontal support shaft 11 is suitably supported on the framework of the sewing machine below and parallel to the support shaft 8. A horizontal support shaft 12 is also suitably supported on the sewing machine framework below and parallel to the shaft 11. An interlocking arm 13 is supported in the center thereof on the support shaft 11 for rotation about the shaft 11. The arm 13 has a pair of arm portions 13*a* and 13*b* with the arm portion 13*a* facing the engaging portion 10*a* of the connector 10. The interlocking arm 13 is normally subjected to resilient force in the clockwise direction as shown in FIG. 1 so as to cause the arm 13*a* to engage the engaging portion 10*a* of the connector 10. A rotary arm 14 is suitably supported on the framework of the sewing machine for rotation about the shaft 12. A connector 15 is rotatably connected at the upper and lower ends to the other end of the rotary arm 14 and the other arm portion 13*b* of the interlocking arm 13, respectively.

The rotary arm 14, arm portion 13*b* and connector 15 constitute a second link means. An operation arm 16 is supported at the base end on the support shaft 12 for rotation about the shaft together with the rotary arm 14 and has at the leading end an inverted U-shaped groove 16*a* which opens downwardly. An operation bar 17 is rotatably supported at the base end thereof on the support shaft 12 and is fitted at the leading end thereof in the U-shaped engaging portion 2*a* of the holding-down arm 2. An intermediate portion between the opposite ends of the bar 17 is fitted in the groove 16*a* in the operation arm 16. The operation bar 17 is formed of resilient and rigid material such as piano wire or the like.

When the electromagnet 5 is energized, the operation bar 17 is pushed by the opposing inner surfaces of the groove 16*a* in the operation arm 16. This causes the holding-down arm 2 to rotate in the counterclockwise direction as seen in FIG. 1 against the resilient force of the coil spring 3 which in turn causes the holding-down foot 4 to abut against the workpiece (not shown).

Reference numeral 18 denotes a support frame fixedly secured to the framework of the sewing machine. A vertical auxiliary holding-down member 19 is supported on the machine framework including the support frame 18 for vertical movement. The auxiliary holding-down member 19 has at the lower end a holding-down portion 19*a* adapted to engage the workpiece in a position adjacent to the needle drop point. The auxiliary holding-down member 19 further has in an upper portion thereof a shoulder 19*b*. A coil spring 20 is wound about the member 19 between the support frame 18 and shoulder 19*b* to normally bias the member 19 upwardly.

Figure 2:
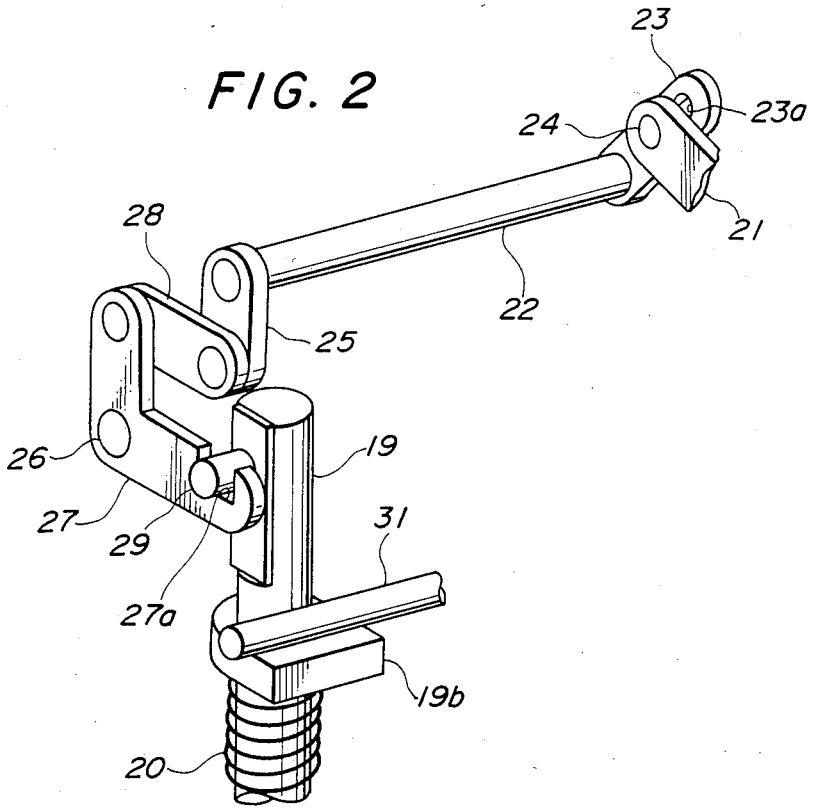
FIG. 2 is a perspective view of disengageable interconnection means for the auxiliary workpiece holding-down member.

In FIG. 2, reference numeral 21 denotes a drive member which has the base end connected to the main shaft of the sewing machine for rocking upwardly and downwardly about the base end thereof in synchronization with the upward and downward movement of the needle. A connector shaft 22 has its axis parallel to the axis of the main shaft and is suitably supported on the sewing machine framework for rotation about its own axis. A follower 23 is fixedly secured at the base end thereof to the connector shaft 22 and has at the leading end a slot 23*a* for receiving a pin 24 on the drive member 21 for movement along the slot. An interlocking arm 25 has the upper end fixedly secured to the connector shaft 22. Reference numeral 26 denotes a stub-shaft having the axis parallel to the axis of the connector shaft 22. An L-shaped engaging arm 27 is rotatably supported in the center thereof on the support shaft 26 for rotation about the shaft 26 and has at the leading end of the horizontal leg thereof a groove 27*a* which opens upwardly. A link 28 is rotatably connected at the opposite ends thereof to the leading end of the vertical leg of the engaging arm 27 and the lower end of the interlocking arm 25, respectively. An engaging pin 29 is fixedly secured to and extends laterally from an upper portion of the auxiliary holding-down member 19 for movement upwardly and downwardly so as to disengage from and engage into the groove 27*a* in the engaging arm 27.

Figure 3:
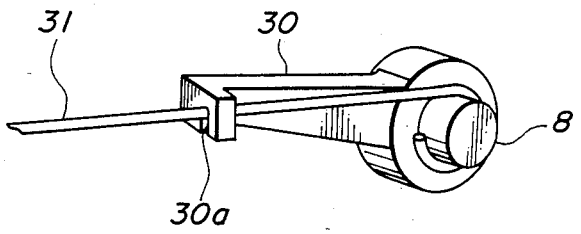
FIG. 3 is a perspective view of the operation arm.

In FIG. 3, reference numeral 30 denotes an operation arm supported on the support shaft 8 for rotation about the shaft together with the rotary arm 9. At the leading end of the arm 30 an inverted U-shaped groove 30*a* opens downwardly. An operation bar 31 is rotatably supported at the base end on the support shaft 8. The bar 31 has a leading end adapted to engage the upper surface of the shoulder 19*a* on the auxiliary holding-down member 19. An intermediate portion between the opposite ends of the bar 31 is fitted in the groove 30*a* in the operation arm 30. The operation bar 31 is formed of resilient and rigid material such as piano wire. When the electromagnet 5 is energized, the operation bar pushes the auxiliary holding-down member 19 downwardly against the resilient force of the coil spring 20 until the engaging pin 29 on the member 19 engages in the engaging groove 27*a* in the engaging arm 27.

With the above-mentioned construction and arrangement of the components of the device according to the present invention, assuming that the sewing machine in its inoperative position, the electromagnet 5 is in its deenergized state. When the electromagnet 5 is in the deenergized state, the operation arm 5*a* assumes the rightward position as shown in FIG. 1. This rotates the drive arm 7 so as to pull the connector 10 upwardly. Whereupon the operation arm 30 rotates together with the rotary arm 9 and releases its pushing force from the operation bar 31. The auxiliary holding-down member 19 acts under the resilient force of the coil spring 20 to hold the engaging pin 29 on the auxiliary holding-down member 19 in the inoperative position above or away from the groove 27*a* in the engaging arm 27. THe interlocking arm 13, normally engages the engaging portion 10*a* on the connector 10, also rotates in the clockwise direction as shown in FIG. 1. The operation arm 16 is adapted to rotate together with the rotary arm 14 to release its pushing force on the operation bar 17. The holding-down arm 2 rotates upwardly, under the resilient force of the coil spring 3, to a predetermined position whereby the holding-down foot 4 and the holding-down portion 19*a* on the auxiliary holding-down member 19 are moved away from the workpiece to a position above the workpiece and maintained in that position.

When the sewing machine is about to start sewing operation, the electromagnet 5 is energized to pull the operation bar 5*a* leftwards as seen in FIG. 1. The drive arm 7 rotates in the counterclockwise direction to lower the connector 10. The rotary arm 9 also rotates in the counterclockwise direction. The operation arm 30 rotates following the rotational movement of the rotary arm 9 to press the operation bar 31 down. When the operation bar 31 is pressed down, the auxiliary holding-down member 19, the shoulder 19*a* of which engages the leading end of the operation bar 31, is pressed down against the resilient force of the coil spring 20. This causes the pin 29 on the auxiliary holding-down member 19 to engage in the groove 27*a* in the engaging arm 27. A connection is thereby established between the main shaft and auxiliary holding-down member. And the interlocking arm 13*a* engaging the engaging portion 10*a* on the connector 10 also rotates in the counterclockwise direction as seen in FIG. 1 to rotate the rotary arm 14 in the counterclockwise direction as seen in FIG. 1. This presses the operation bar 17 down, by means of the operation arm 16. The operation arm follows the rotary arm 14 and rotates the holding-down arm 2, the engaging portion 2*a* of which engages the leading end of the operation bar 17 in the counterclockwise direction against the resilient force of the coil spring 3. Whereby the holding-down foot 4 is pressed against the workpiece to thereby pinch the workpiece (not shown) between the foot and feed bar. Substantially at the same time, the sewing machine starts a cycle sewing operation and the drive member 21 moves upwardly and downwardly in synchronization with the upward and downward movement of the sewing needle (not shown) in response of the rotation of the sewing machine main shaft.

In response to the upward and downward movement of the drive member 21, the connector shaft 22, acts to rock the engaging arm 27 about the support shaft 26 via the interlocking arm 25 and connector 28. The auxiliary holding-down member 19, having the engaging pin 29 engaged in the groove 27*a*, rocks in response to the rocking movement of the engaging arm 27 while compressing and releasing the coil spring 20. At the end of the downward movement of the auxiliary holding-down member 19 (while the needle is piercing through the workpiece), the holding-down portion 19*a* on the holding-down member 19 resiliently abuts against the workpiece, under the resiliency of the operation bar 31, at the area defined by the frame of the frame-shaped holding-down foot 4.

At the completion of the cycle of a sewing operation on the sewing machine, the electromagnet 5 is deenergized whereupon the operation bar 5*a* returns to the rightward position as shown in FIG. 1. Thus, the holding-down arm 2 is raised to the position above the workpiece feed bar under the resilient force of the coil spring 3. The auxiliary holding-down member 19 is also raised under the resilient force of the coil spring 20 to the inoperative position in which the engaging pin 29 disengages from the groove 27*a* as mentioned hereinabove.

As clear from the foregoing description on the preferred embodiment of the present invention, according to the present invention, the workpiece holding-down member 2 having the holding-down foot 4 at the lower end is vertically movable between the lower position in which the holding-down foot abuts against the workpiece on the sewing machine bed and the upper position in which the holding-down foot is positioned above the machine bed. The workpiece holding-down member 2 is normally biased to the upper position under resilient force. The auxiliary holding-down member 19 is vertically movable in synchronization with the upward and downward movement of the needle in response to the rotation of the main shaft between the operative or lower position in which the member abuts against the workpiece on the sewing machine bed and the inoperative or upper position in which the member is positioned about the machine bed. The disengageable interconnecting means 27*a*, 29 is interposed between the sewing machine main shaft and auxiliary holding-down member 19. The interconnecting means connects the sewing machine main shaft and auxiliary holding-down member 19 when the auxiliary holding-down member is in the operative position and interrupts the connection when the auxiliary holding-down member is in the inoperative position. The electromagnet means 5 is energized when the sewing machine is about to start operation and deenergized at the completion of a seam. The operation means operates in response to the energization of the electromagnet so as to move the holding-down arm 2 and auxiliary holding-down member 19 to their operative positions against resilient force. The operation means moves the members 2 and 19 to the upper position assisted by said resilient force upon the deenergization of the electromagnet 5. The holding-down foot 4 and auxiliary holding-down member 19 can be lowered and held in the lowered position at the start of a sewing cycle and raised and held in the raised position at the completion of the sewing cycle. By this arrangement, the drawback that the holding-down foot 4 tends to engage the auxiliary holding-down member 19, if the holding-down foot rises to a high position at the completion of a sewing cycle as experienced in the prior art sewing machines, can be effectively overcome whereby the workpiece can be easily fed to or removed from the sewing zone.

While only one embodiment of the invention has been shown and described in detail, it will be understood that the same is for illustration purpose only and not to be taken as a definition of the inventon, reference being had for this purpose to the appended claim.

What is claimed is:

1. In a sewing machine having a main shaft rotatable to drive a needle to perform sewing on a workpiece, said sewing machine being characterized by:

a workpiece holding-down arm;

a workpiece holding-down foot at one end of said arm and movable between a lowered position in which said holding-down foot abuts against the workpiece and an upper position in which said holding-down foot is about the workpiece;

an auxiliary workpiece holding-down member movable between an operative position in which said auxiliary workpiece holding-down member engages the workpiece and an inoperative position in which said auxiliary holding-down member is above the workpiece;

disengageable interconnecting means interposed between the main shaft and auxiliary holding-down member for connecting between the main shaft and auxiliary holding-down member when the auxiliary holding-down member is in the operative position and interrupting the connection when said auxiliary holding-down member is in the inoperative position, said interconnecting means being operable to reciprocate said auxiliary holding-down member in synchronism with rotation of the main shaft when said auxiliary workpiece holding-down member is in the operative position, said interconnecting means being ineffective to reciprocate said auxiliary holding-down member when said auxiliary holding-down member is in the inoperative position;

electromagnetic means adapted to be energized when said sewing machine is about to start operation and deenergized upon the completion of formation of a predetermined number of seams; and operation means operable in response to energization of said electromagnetic means to impart operation force to said holding-down arm and auxiliary holding-down member to cause the holding-down arm to move to said lowered position and to cause said auxiliary holding-down member to move to said operative position, said operation means being operable in response to deenergization of the electromagnetic means to cause said holding-down arm to move away from said lowered position and to cause said auxiliary holding-down member to move to said inoperative position.

2. An apparatus for use in a sewing machine, said apparatus comprising a presser foot movable between a raised condition and a lowered condition in which said presser foot engages a workpiece in the sewing machine, an auxiliary holding-down member movable between a raised condition and a lowered condition in which said auxiliary holding-down member engages a workpiece in the sewing machine, means for simultaneously raising and lowering said presser foot and auxiliary holding-down member between their raised and lowered conditions, drive means operable between an engaged condition in which said drive means is effective to reciprocate said auxiliary holding-down member and a disengaged condition in which said drive means is ineffective to reciprocate said auxiliary holding-down member, and means for operating said drive means from the disengaged condition to the engaged condition upon movement of said auxiliary holding-down member from its raised condition to its lowered condition and for operating said drive means from the engaged condition to the disengaged condition upon movement of said auxiliary holding-down member from its lowered condition to its raised condition so that said drive means is effective to reciprocate said auxiliary holding-down member only when said auxiliary holding-down member is in its lowered condition.

* * * * *